US005722658A

United States Patent [19]

Talmage et al.

[11] Patent Number: 5,722,658

[45] Date of Patent: Mar. 3, 1998

[54] SAFETY BOARD GAME

[75] Inventors: Roberta Talmage, Willowbrook; Mark Bosse, Justice; Michael Hugdahl, Naperville; Edward A. Kuske, Chicago; Felix C. Legge, Oakbrook Terrace; Frank A. Pyrz, Hickory Hills; Tom Siil, LaGrange Park; Barbara Uicker, Willow Springs; Ellen Carol Ann Young, LaGrange, all of Ill.

[73] Assignee: CPC International Inc., Englewood Cliffs, N.J.

[21] Appl. No.: 589,837

[22] Filed: Jan. 22, 1996

[51] Int. Cl.[6] ..... A63F 3/00

[52] U.S. Cl. ..... 273/243; 273/429; 273/256; 434/219

[58] Field of Search ..... 273/243, 252, 273/253, 256, 257, 278, 429, 430, 431; 434/219

[56] References Cited

U.S. PATENT DOCUMENTS

| | | | |
|---|---|---|---|
| 2,145,394 | 1/1939 | Hobbs et al. | 273/248 |
| 2,189,159 | 10/1940 | Donnelly | 273/254 |
| 4,032,154 | 6/1977 | Magiera | 273/134 |
| 4,040,628 | 8/1977 | Pope | 273/243 |
| 4,557,485 | 12/1985 | Lardon | 273/249 |
| 4,953,871 | 9/1990 | Antwi | 273/252 |
| 5,002,283 | 3/1991 | Langham et al. | 273/252 |
| 5,259,623 | 11/1993 | Kanelos, Sr. | 273/249 |
| 5,388,835 | 2/1995 | Albright | 273/249 |
| 5,478,086 | 12/1995 | Aylett | 273/249 |

FOREIGN PATENT DOCUMENTS

| | | | |
|---|---|---|---|
| 2231277 | 11/1990 | United Kingdom | 273/243 |

*Primary Examiner*—William M. Pierce

*Attorney, Agent, or Firm*—Brooks Haidt Haffner & Delahunty

[57] ABSTRACT

A board game apparatus for teaching industrial safety rules and procedures includes a game board, playing pieces, question cards and a score card. The game board includes a representation of various component parts of an industrial organization, and a path connecting the component parts. During the course of the game, the playing pieces are moved along the path and the players answer questions from the question cards relating to various safety topics for the workplaces within the organization. The first player to answer questions successfully to each of the safety topics and return to the start position wins the game.

10 Claims, 3 Drawing Sheets

FIG. 2A

26A

PERSONAL PROTECTIVE EQUIPMENT

FIG. 2B

26B

LOGOUT AND TAGOUT

26C FIG. 2C

CONFINED SPACE

FIG. 2D

26D

HAZARD COMMUNICATION

FIG. 2E

26E

PROCESS SAFETY MANAGEMENT

26F FIG. 2F

EMERGENCY ACTION PLAN

FIG. 2G

26G

BLOODBORNE PATHOGENS

FIG. 2H

26H

PERMITS

26I FIG. 2I

TRUE OR FALSE? IF A CONDITION LISTED ON THE HOT WORK PERMIT DOES NOT APPLY TO THE SPECIFIC WORK YOU ARE DOING, YOU MAY WRITE NA(NOT APPLICABLE) ON THE PERMIT

FALSE
NA IS NOT AN ACCEPTABLE ANSWER ON A HOT WORK PERMIT. WRITE"NONE"INSTEAD

SAFETY BOARD GAME

BACKGROUND OF THE INVENTION

1. Field of the Invention

The present invention relates to board games, and more particularly to a board game which includes chance and educational and instructive features relating to industry safety procedures, as well as being entertaining to play.

2. Description of the Related Art

A variety of board games are known. For example, U.S. Pat. No. 4,032,154 describes a game board with marked spaces and a path of progression about the board. Sets of cards are provided to indicate game points and individualized markers or tokens used to designate each player. Dice are used to indicate the number of spaces to be moved in a given turn.

U.S. Pat. No. 4,557,485 describes a game board similar to that in U.S. Pat. No. 4,032,154, but where the sets of cards bear questions thereon to which the players must reply.

U.S. Pat. Nos. 4,953,871, 5,002,283 and 5,259,623 describe other game board configurations where the object of the game includes an educational component. Each of the three patents, for example, are directed to driver education and traffic safety games in which driving conditions are simulated with elements of chance, such as dice and drawn cards.

None of the aforementioned references, however, disclose a board game for teaching safety rules and procedures in other contexts, such as safety in the workplace. The need for such an educational safety training game is clear, particularly where hazardous conditions and numerous and complicated rules and procedures for operating under such conditions are present. Making the learning and review of these rules and procedures interesting and enjoyable facilitates the teaching process for those involved and leads to more safety conscious workers and safer work places.

SUMMARY OF THE INVENTION

A board game apparatus for teaching industrial safety rules and procedures includes a game board, playing pieces, question cards and a score card. The game board includes a representation of various component parts of an industrial organization, and a path connecting the component parts. During the course of the game, the playing pieces are moved along the path and the players answer questions from the question cards relating to various safety topics for the workplaces within the organization. The first player to answer questions successfully to each of the safety topics and return to the start position wins the game.

BRIEF DESCRIPTION OF THE DRAWINGS

FIG. 2A is a top view of the front side of a "Personal Protective Equipment" (PPE) card used during the course of play of the present game;

FIG. 2B is a top view of the front side of a "Logout and Tagout" card used during the course of play of the present game;

FIG. 2C is a top view of the front side of a "Confined Space" card used during the course of play of the present game;

FIG. 2D is a top view of the front side of a "Hazard Communication" card used during the course of play of the present game;

FIG. 2E is a top view of the front side of a "Process Safety Management" (PSM) card used during the course of play of the present game;

FIG. 2F is a top view of the front side of an "Emergency Action Plan" (EAP) card used during the course of play of the present game;

FIG. 2G is a top view of the front side of a "Bloodborne pathogens" card used during the course of play of the present game;

FIG. 2H is a top view of the front side of a "Permits" card used during the course of play of the present game;

FIG. 2I is a view of the bottom side of the "Permits" card shown in FIG. 2H with a representative question and answer printed thereon;

DETAILED DESCRIPTION OF THE PREFERRED EMBODIMENT

Figure 1:
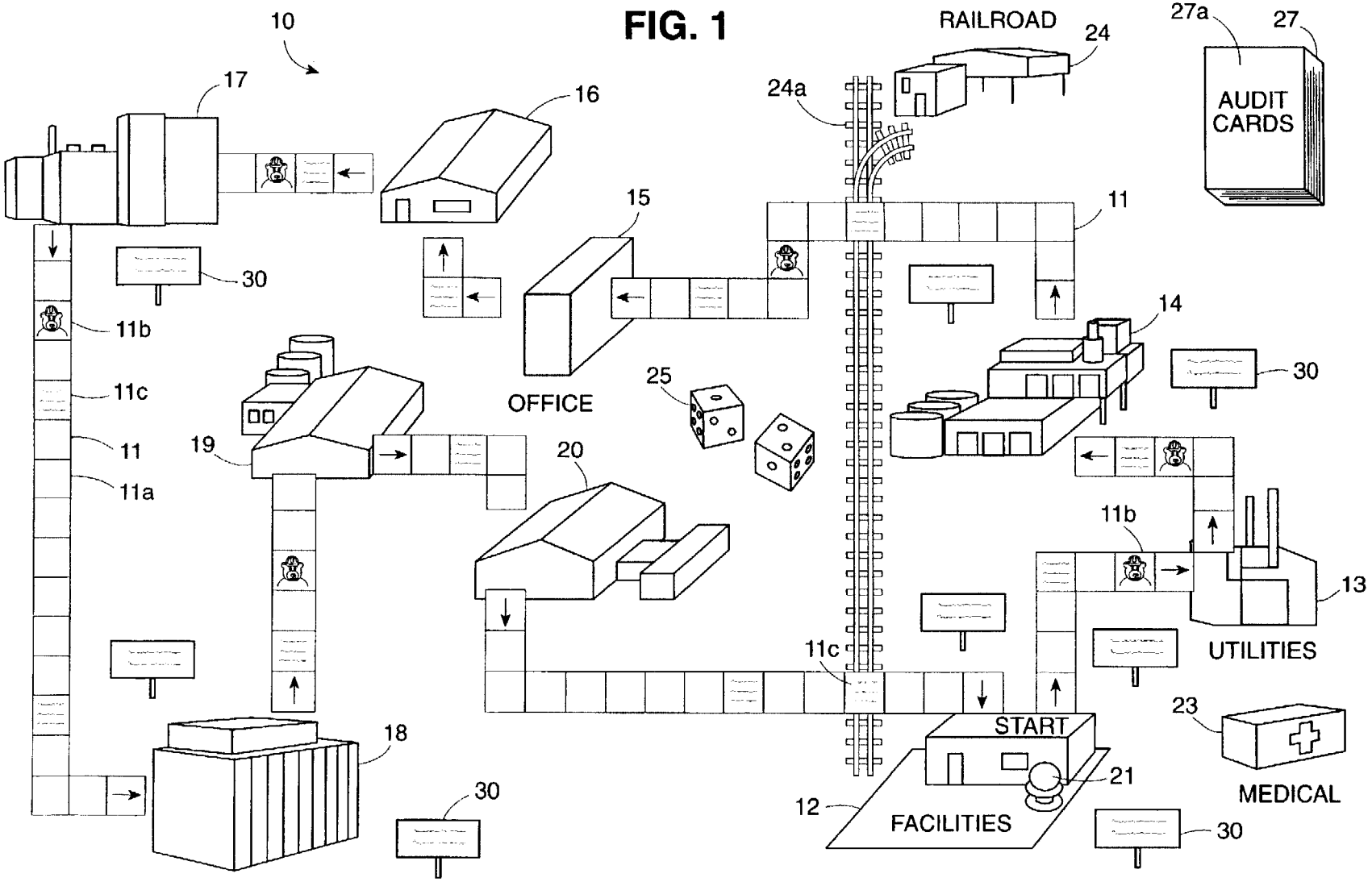
FIG. 1 is a top plan view of a game board apparatus according to the present invention, including plane and perspective views of various of the remaining apparatus for playing the board game, such as playing pieces, cards and dice.

Referring now particularly to FIG. 1 of the drawings, the board game apparatus of the present invention includes a generally rectangular game board 10 with a playing surface 10*a* upon which the board game for entertainingly teaching various aspects of industrial safety rules and procedures in one or more workplaces is played. Playing surface 10*a* includes a plurality of representations for separate components of an industrial organization serially connected to each other by a playing path 11. In particular, the path 11 in FIG. 1 circuitously connects representations of various buildings, such as would be found in a chemical manufacturing and processing organization which has several plants producing different products. For example, the following components are shown in counterclockwise order in FIG. 1 along the path 11: a Facilities 12, the designated starting and ending position of the game, a Utilities 13, a First Plant 14, an Office 15, a Second Plant 16, a Third Plant 17, a Research & Headquarters Complex 18, a Fourth Plant 19 and a Fifth Plant 20. The direction of game movement around the path 11 is shown by the arrows leading from the start position, Facilities 12, to Utilities 13 and so forth.

Path 11 is divided into a plurality of individual segments or spaces 11*a* arranged sequentially and continuously between the respective industrial components 12–20. Some of the spaces 11*a*, designated as "Audit" squares 11*b*, are associated with safety testing, and others are instructional spaces 11*c*, which include a simple game instruction, for example, moving forward or backward a given number of spaces, admonishments to not stop on railroad tracks or a go to medical command.

Figure 3B:
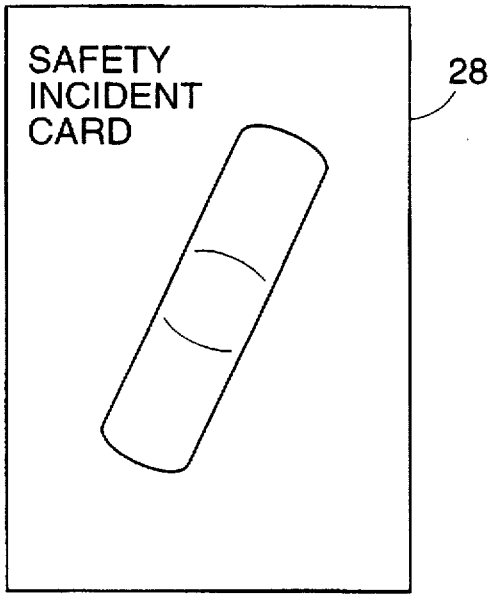
FIG. 3B is a top view of the front side of a "Safety Incident" card used during the course of play of the present game.

Positional markers or playing pieces 21, as shown in FIG. 1, are used by the players to traverse the path 11 and mark their respective positions on the game board 10 during the course of the game. It should be understood that a variety of shapes, sizes and colors may be used to better differentiate the playing pieces 21 from one another. For example, playing pieces 21 in the shapes of objects associated with a particular industry, e.g., scaled-down versions of hard hats, as shown in FIG. 1, ear plugs, safety goggles, boots, etc., may be used. To facilitate keeping score during the course of play each player has a Plant Access Card or score card 22, as shown in FIG. 3A.

With further reference to FIG. 1, playing surface 10*a* includes another building representation, Medical 23, which is isolated from the other components 12–20 and not connected to the path 11. Players reach Medical 23 as a result of a game instruction, such as from one of the instructional spaces 11*c* or other means, as will be described, received during play. Another building representation shown on playing surface 10*a* in FIG. 1 is a Railroad 24, the tracks 24*a* of which cross the path 11 at a plurality of instructional spaces 11*c*. The spaces 11*c* at each intersection bear a warning message not to stop on the tracks 24*a* and an instruction to move away.

Chance means, such as dice 25 shown in FIG. 1, are employed to randomly determine the magnitude of each player's move of her playing piece 21 along the path 11. Dice 25 also provide for additional variance in player movement, such as the option of getting another turn for rolling doubles. Additional or other chance means, such as drawn cards or a number wheel, may be used if desired.

The present game is intended for play by one or more players. The description of the play for the present game will assume that at least two players are involved. The object of the game of the present invention is to be the first player to correctly answer one or more questions relating to each of various facets of industrial safety rules and procedures, such as topics relating to the Occupational Safety and Hazard Act (OSHA). A plurality of questions relating to each of said facets or topics of safety are set forth on a multiplicity of safety topic cards 26. According to the preferred embodiment, eight categories of safety topics are used in the board game of the invention: (1) Personal Protective Equipment (PPE), (2) Logout and Tagout, (3) Confined Space, (4) Hazard Communication, (5) Process Safety Management (PSM), (6) Emergency Action Plan (EAP), (7) Bloodborne Pathogens, and (8) Permits. Cards 26A–26H, corresponding to each of the above-listed safety topics, are shown in FIGS. 2A–2H, respectively. Information and a question for each safety topic are set forth on the reverse side of the respective cards shown in FIGS. 2A–2H, as shown in FIG. 2I, which illustrates a representative safety question used in Permits. Preferably, a multiplicity or deck of each of the respective cards 26A–26H is used in the game with different questions pertaining to just one safety topic on each respective card within that deck. A player successfully answering a question on one of the safety topics has completed that topic and need not answer any further questions in that topic. To indicate the completion of a given safety topic the players can have a hole punched through a respective portion of their score card 22. As shown in FIG. 3A, score card 22 may abbreviate some of the safety topics, e.g., PPE, PSM and EAP, representing Personal Protective Equipment, Process Safety Management and Emergency Action Plan, respectively.

The game is begun by the players each selecting their own playing piece 21 and placing their pieces at the start position, i.e., Facilities 12. It should be understood that the players themselves may determine the order of play or the dice 25 may be used to randomly determine which of the players moves first, with the player having the highest number moving first, the second highest moving second, etc. With the order of play established, the players then take turns rolling the dice 25 and moving their respective playing pieces 21 along the path 11 the number of spaces 11*a* indicated by the dice 25.

At the conclusion of a given move, a player resting upon one of the audit squares 11*b* draws a card 27*a* from an audit card deck 27, shown in FIG. 1. Each card 27*a* in the deck 27 indicates the occurrence of a random and unusual event that affects game play in some way. For example, the card 27*a* may instruct that for not following adequate safety procedures, the player must move their playing piece 21 back a number of spaces 11*a* or forward if proper safety procedures were followed. More serious infractions of safety rules result in more serious game penalties for that player, such as losing one's turn or having to report to Medical 23, i.e., removing their playing piece 21 from the path 11. Conversely, exemplary safety behavior and training is awarded with taking an extra turn. As previously indicated, players whose playing pieces 21 land on the instruction spaces 11*c* act in accordance with the instruction set forth in that particular square 11*c*, for example, moving forward or backward, going to Medical 23 or other instructions, such as getting a bandaid after receiving a paper cut. The audit cards 27*a* and audit squares 11*b*, being directed to safety procedures, preferably have a safety symbol thereon, such as a polar bear with a hardhat, which is emblematic for a particular organization. It should, of course, be understood that other safety symbols may be used for games in different industries or organizations.

A player whose playing piece 21 lands on one of the organization components 12–20, such as Utilities 13, at the conclusion of a move selects one of the aforedescribed safety topics, such as Logout & Tagout, and draws a card, card 26B, containing a question on that safety topic. As discussed, the player should preferably select a safety topic and draw a respective card 26 corresponding thereto that has not yet been answered correctly by that player. A correct answer to a safety question on a card 26 entitles the player to have her score card 22 punched accordingly and she also receives another turn. A player's turn ends after moving the indicated number of spaces 11*a* shown on the dice 25 and when the player has no further action to take. Subsequent landings on the same or other of the components 12–20 offer additional player opportunities to answer safety questions on the remaining and unpunched safety topics. An incorrect answer to a safety question results in a penalty: the player receives a safety incident card 28, shown in FIG. 3B, and loses her turn. Receipt of three such incident cards 28 means that the player must proceed immediately to Medical 23 with loss of her turn. Play resumes with the next player.

Figure 3C:
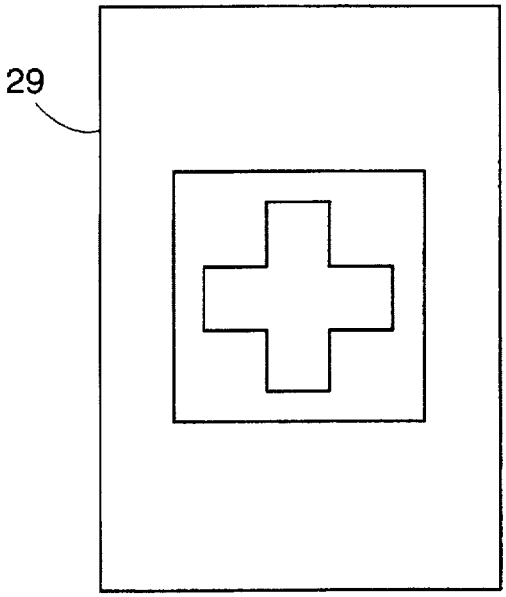
FIG. 3C is a top view of the front side of a "Medical" card, as represented by the cross emblem, used during the course of play of the present game.
Figure 3A:
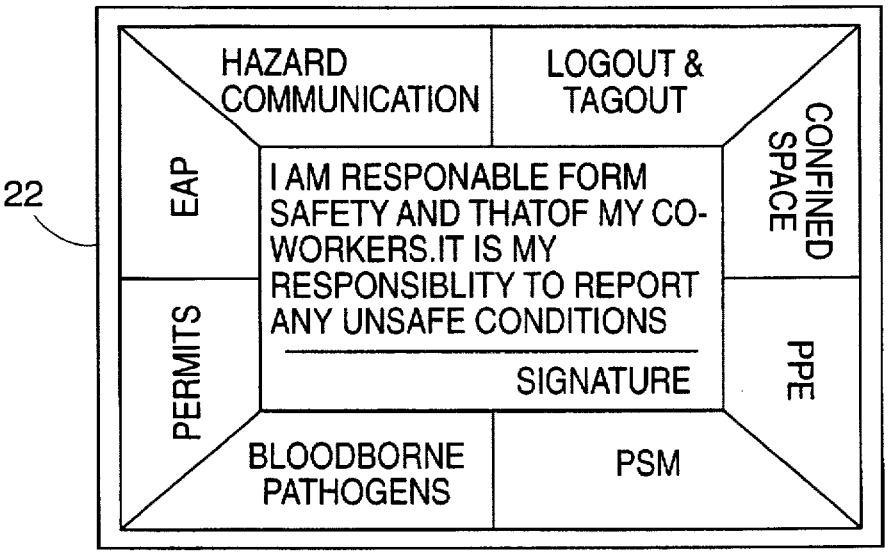
FIG. 3A is a top view of the front side of a "Plant Access" card used during the course of play at the present game.

Players landing in Medical 23, whether from instructions from the squares 11*c*, cards 26 or receipt of three safety incident cards 28, must correctly answer a question relating to medical safety procedures indicated on a medical card 29, as shown in FIG. 3C. Upon correctly answering one of the questions on the medical card 29, the player's "recuperation" has ended and the player returns to play. In particular, the playing piece 21 for that player is placed on the last space 11*a* or organizational component 12–20 traversed by that player and play resumes from there on her next turn. Incorrect answers to questions while in Medical 23 result in loss of that turn but no change in position.

When a player successfully answers at least one question from each safety topic, i.e., her score card 22 has punches through each of the eight safety topic areas, the player must then proceed to the starting point, Facilities 12, which also serves as the ending point. The first such player to return to Facilities 12 wins the game.

It should be understood that the score card 22, which as shown in FIG. 3A includes an oath and signature line, may also serve as a record of employee training. To better serve as such a training record, the card 22 should also include a date of game completion.

As further shown in FIG. 1, safety signs 30 "posted" near various of the components 12–20 of the industrial organization each bear a safety warning or instruction. For example, sign 30 near the First Plant 14 bears the warning "Caution Bees", which instructs the game player about a particular hazard at Plant 14. Other signs 30 bear other messages or instructions pertaining to particular hazards or problems at other components.

It should also be understood that the particular layout of the organization's component parts on the game board 10, the types of buildings shown, the number and types of questions and other factors may vary in accordance with the type of industry being modeled, and that the present invention should not be so limited to the particular configuration or industry set forth herein.

It is therefore to be understood that the board game described above may be adapted for use for any industry such as manufacturing, assembly, service and the like, in which safety rules and procedures are utilized. It should also be understood that the board game may be adapted for use in other countries and/or translated into foreign languages.

It should further be understood that the game rules may be modified to suit the player(s). For example, for solitary play, the player need not lose their turn. Also, one or more particular safety topics can be designated for particular organizational components 12–20. For example, when a player lands on the Third Plant 17, only a question card for Hazard Communication, card 26D, may be asked. Similarly, each of the eight safety topics listed in the preferred embodiment of the invention and the corresponding cards 26A–26H thereto may be assigned to one or more of the organizational components 12–20, requiring the player to land on each component 12–20 and successfully answer the respective topic question to complete the game.

It should also be understood that the cards 26 need not include separate decks of cards 26A–26H for the respective safety topics but may instead constitute a single deck of cards 26 with questions for each of the safety topics listed on each card.

Having set forth a description of the invention and a preferred embodiment thereof, the scope is now more particularly set forth in the appended claims.

What is claimed is:

1. A board game apparatus for teaching safety in a workplace, comprising:

(a) a game board having a playing surface with differentiated markings thereon, including:

(1) symbolic representations of a multiplicity of component units of an industrial organization; and (2) a multiplicity of serially connected path segments connecting said component units and forming a path therebetween;

(b) a plurality of playing pieces for movement along said path, each of said playing pieces representing at least one player;

(c) chance means for specifying the number of path segments that a player can move their respective playing piece along said path during a given turn;

(d) a multiplicity of first safety cards, each of said first safety cards relating to at least one safety topic within said industrial organization and indicating information pertaining to said at least one safety topic, one of said first safety cards being drawn upon landing one of said playing pieces on one of said component units of said industrial organization on said game board, said information on said drawn card including a question relating to said at least one safety topic;

(e) a multiplicity of second safety cards for affecting game play by including one of a plurality of game instructions, wherein each of the game instructions directs movement of a playing piece on the game board based on whether the game instruction indicates an adherence to or an infraction of a safety rule related to an occurrence of an unusual safety event, said path segments comprising at least one event path segment, one of said second safety cards being drawn upon landing one of said playing pieces on said at least one event path segment; and (f) scoring means for recording at least one successful response to said question relating to said at least one safety topic, whereby once a player successfully responds to questions relating to each of said safety topics that player wins the game.

2. The board game apparatus according to claim 1, wherein said multiplicity of first safety cards comprises a multiplicity of subsets thereof, each card within a respective subset relating to a safety topic different from that of the other subsets.

3. The board game apparatus according to claim 1, comprising a multiplicity of playing pieces.

4. The board game apparatus according to claim 1, wherein said chance means comprises dice.

5. The board game apparatus according to claim 1, wherein said path segments comprise at least one instructional path segment having a game instruction thereon.

6. The board game according to claim 1, wherein said scoring means comprises a score card.

7. A board game apparatus for teaching safety in a workplace, comprising:

a) a game board having a playing surface with differentiated markings thereon, including:

(1) symbolic representations of a multiplicity of component units of an industrial organization; and (2) a multiplicity of serially connected path segments connecting said component units and forming a path therebetween;

(b) a plurality of playing pieces for movement along said path, each of said playing pieces representing at least one player;

(c) chance means for specifying the number of path segments that a player can move their respective playing piece along said path during a given turn;

(d) a multiplicity of first safety cards, each of said first safety cards relating to at least one safety topic within said industrial organization and indicating information pertaining to said at least one safety topic, one of said first safety cards being drawn upon landing one of said playing pieces on one of said component units of said industrial organization on said game board, said information on said drawn card including a question relating to said at least one safety topic;

(e) a multiplicity of second safety cards, each of said second safety cards relating to an occurrence of an unusual event, said path segments comprising at least one event path segment, one of said second safety cards being drawn upon landing one of said playing pieces on said at least one event path segment;

(f) scoring means for recording at least one successful response to said question relating to said at least one safety topic, whereby once a player successfully responds to questions relating to each of said safety topics that player wins the game; and (g) a symbolic representation of an additional industrial organization component unit not connected to said path, to which one of said playing pieces moves upon the occurrence of an event, a multiplicity of third safety cards relating to an additional safety topic within said additional industrial organization component unit and indicating information relating to said additional safety topic, one of said third safety cards being drawn during a turn of the player of said one of said playing pieces, said information on said drawn card including a question relating to said additional safety topic, and upon the occurrence of a successful response by said player to said question relating to said additional safety topic said one of said playing pieces is returned to said path.

8. A method of playing an industrial organization safety education board game, comprising the following steps:

(a) providing a generally rectangular game board having a playing surface with differentiated markings thereon indicating (1) symbolic representations of a multiplicity of component units of said industrial organization and (2) a multiplicity of serially connected path segments connecting said component units and forming a path therebetween, said path segments comprising at least one event path segment;

(b) further providing playing pieces, chance means for the determination of moves of the playing pieces, a multiplicity of first safety cards relating to at least one safety topic within said industrial organization and indicating at least one question relating to said at least one safety topic, and a multiplicity of second safety cards for affecting game play by including one of a plurality of game instructions, wherein each of the game instructions directs movement of a playing piece on the game board based on whether the game instruction indicates an adherence to or infraction of a safety rule related to an occurrence of an unusual safety event;

(c) choosing a playing piece for each player, placing each playing piece at a start position on said game board, and determining an order of play for the players;

(d) manipulating the chance means and using the result to determine the extent of the move for the playing piece for a given player and moving said playing piece along said path in accordance with said result;

(e) drawing one of said first safety cards upon landing one of said playing pieces on one of said component units of said industrial organization and responding to said at least one question, and drawing one of said second safety cards upon landing one of said playing pieces on said at least one event path segment and performing said indicated game instruction; and (f) repeating steps (d)–(e) with each of the players alternatingly taking turns until a player has successfully responded to questions from each of said at least one safety topic, thereby winning the game.

9. The method according to claim 8, further comprising keeping track of the successful responses to said questions on said first safety cards by means of a score card.

10. A method of playing an industrial organization safety education board game, comprising the following steps:

(a) providing a generally rectangular game board having a playing surface with differentiated markings thereon indicating (1) symbolic representations of a multiplicity of component units of said industrial organization and (2) a multiplicity of serially connected path segments connecting said component units and forming a path therebetween, said path segments comprising at least one event path segment;

(b) further providing playing pieces, chance means for the determination of moves of the playing pieces, a multiplicity of first safety cards relating to at least one safety topic within said industrial organization and indicating at least one question relating to said at least one safety topic, and a multiplicity of second safety cards relating to an occurrence of an unusual event and indicating a game instruction;

(c) choosing a playing piece for each player, placing each playing piece at a start position on said game board, and determining an order of play for the players;

(d) manipulating the chance means and using the result to determine the extent of the move for the playing piece for a given player and moving said playing piece along said path in accordance with said result;

(e) drawing one of said first safety cards upon landing one of said playing pieces on one of said component units of said industrial organization and responding to said at least one question, and drawing one of said second safety cards upon landing one of said playing pieces on said at least one event path segment and performing said indicated game instruction;

(f) repeating steps (d)–(e) with each of the players alternatingly taking turns until a player has successfully responded to questions from each of said at least one safety topic and returned to the start position, thereby winning the game;

(g) providing a symbolic representation of an additional industrial organization component unit not connected to said path, a multiplicity of third safety cards relating to an additional safety topic within said additional component unit and indicating at least one question relating to said additional safety topic;

(h) moving said playing piece off of said path to said additional component unit in response to a game instruction;

(i) drawing one of said third safety cards on turn subsequent to landing said playing piece on said additional component unit and responding to said at least one question; and (j) continuing at each turn to draw one of said third safety cards until successfully responding to said at least one question, and upon which returning said playing piece to said path.

* * * * *